US011407136B2

(12) United States Patent
Kuwabara et al.

(10) Patent No.: US 11,407,136 B2
(45) Date of Patent: Aug. 9, 2022

(54) TRIMMER

(71) Applicant: Horizon International Inc., Shiga (JP)

(72) Inventors: Yoshinari Kuwabara, Shiga (JP); Osamu Nishimura, Shiga (JP); Satoshi Tsunawaki, Shiga (JP)

(73) Assignee: HORIZON INTERNATIONAL INC., Shiga (JP)

( * ) Notice: Subject to any disclaimer, the term of this patent is extended or adjusted under 35 U.S.C. 154(b) by 0 days.

(21) Appl. No.: 16/641,287

(22) PCT Filed: Sep. 6, 2017

(86) PCT No.: PCT/JP2017/032082
§ 371 (c)(1),
(2) Date: Feb. 24, 2020

(87) PCT Pub. No.: WO2019/049233
PCT Pub. Date: Mar. 14, 2019

(65) Prior Publication Data

US 2020/0353639 A1 Nov. 12, 2020

(51) Int. Cl.
*B26D 1/08* (2006.01)
*B26D 7/26* (2006.01)
(Continued)

(52) U.S. Cl.
CPC ..... *B26D 7/26* (2013.01); *B26D 1/08* (2013.01); *B26D 5/16* (2013.01); *B26D 7/0675* (2013.01);
(Continued)

(58) Field of Classification Search
CPC ... B26D 7/26; B26D 1/08; B26D 5/16; B26D 7/0675; B26D 2007/0056; B26D 2007/0081; B65H 35/06
(Continued)

(56) References Cited

U.S. PATENT DOCUMENTS 3,242,786 A * 3/1966 Giordano ..... B23D 35/00 83/380
4,295,400 A * 10/1981 Larson ..... B26D 7/24 83/545
(Continued)

FOREIGN PATENT DOCUMENTS

CN 202922624 U 5/2013
CN 106671153 A 5/2017
(Continued)

OTHER PUBLICATIONS

International Search Report dated Nov. 21, 2017 in corresponding International patent application No. PCT/JP2017/032082.
(Continued)

*Primary Examiner* — Evan H MacFarlane
*Assistant Examiner* — Liang Dong
(74) *Attorney, Agent, or Firm* — Kirschstein, Israel, Schiffmiller & Pieroni, P.C.

(57) ABSTRACT

A trimmer comprises a trim knife for trimming the bound material, a blade receiving portion 19 for receiving a blade edge of the trim knife, and an adjustment mechanism 60 configured to adjust a position of the blade receiving portion 19 in such a manner that each of one side 191 and other side 192 of the blade receiving portion 19 moves by not only a same amount but also a different amount and in directions toward and away from the blade edge of the trim knife. Each of positions of the one side 191 and the other side 192 of the blade receiving portion 19 can be adjusted.

6 Claims, 6 Drawing Sheets

(51) Int. Cl.
*B26D 5/16* (2006.01)
*B26D 7/06* (2006.01)
*B26D 7/00* (2006.01)

(52) U.S. Cl.
CPC ..... *B26D 2007/0056* (2013.01); *B26D 2007/0081* (2013.01)

(58) Field of Classification Search
USPC ..... 83/563, 557, 561, 658, 545, 247, 344, 83/723, 421, 699.11, 699.31, 694
See application file for complete search history.

(56) References Cited

U.S. PATENT DOCUMENTS

| | | | | |
|---|---|---|---|---|
| 4,462,291 | A * | 7/1984 | Schulz | B26F 1/40 83/368 |
| 6,860,184 | B1 * | 3/2005 | Chen | B26D 1/085 83/582 |
| 7,493,840 | B2 | 2/2009 | Yamaguchi | |
| 7,506,864 | B2 | 3/2009 | Wakabayashi et al. | |
| 9,908,188 | B2 * | 3/2018 | Round | B23D 35/005 |
| 2006/0072954 | A1 | 4/2006 | Kaneko et al. | |
| 2006/0081106 | A1 * | 4/2006 | Nishimura | B26D 7/025 83/665 |
| 2013/0106041 | A1 * | 5/2013 | Noda | B41F 15/36 269/58 |

FOREIGN PATENT DOCUMENTS

| | | | |
|---|---|---|---|
| DE | 4024615 | A1 | 2/1992 |
| JP | S48-103983 | | 12/1973 |
| JP | 2004-066347 | | 3/2004 |
| JP | 2006-102882 | A | 4/2006 |
| JP | 2008-030131 | | 2/2008 |
| JP | 2008-142790 | A | 6/2008 |
| JP | 2009-113150 | A | 5/2009 |
| JP | 2011-136394 | | 7/2011 |
| JP | 2016-221667 | | 12/2016 |

OTHER PUBLICATIONS

Extended European Search Report dated Mar. 11, 2021, EP Application No. 17924045.2, pp. 1-7.
China National Intellectual Property Administration, First Office Action on Application No. 201780094315.9, dated Feb. 3, 2021.
Office Action in JP 2019-516016, dated Jan. 25, 2022 (English translation).

* cited by examiner 19b
19a
182
184
192
191
183
181
19
18
65
66
72
650
60
620
62
70
7
100
63
630
64
71
610
61

TRIMMER

TECHNICAL FIELD OF THE INVENTION

The present invention relates to a trimmer for trimming a bound material.

BACKGROUND OF THE INVENTION

A conventional trimmer is described in, for example, Patent Document 1. The trimmer comprises: a single trim knife reciprocated in a vertical direction and between a non-cutting position and a cutting position; and a table for positioning the bound material placed thereon. In this conventional trimmer, an operator puts the bound material on the table and positions it properly, and then moves the trim knife from the non-cutting position to the cutting position so as to cut an edge portion of the bound material. The operator rotates and positions the bound material at each of top, bottom and from edge cutting positions, sequentially. The operator reciprocates the trim knife at each of the positions so as to cut each of the top, bottom and front edge portions. Thus, each of the edge portions of the bound material is trimmed.

The other conventional trimmer described in, for example, Patent Document 2 is a three-side trimmer. The three-side trimmer comprises: a single trim knife reciprocated in a vertical direction between a non-cutting position and a cutting position; a table for positioning a bound material placed thereon; and a rotate mechanism for rotating the table. A feeding mechanism supplies the bound material to the table, and the table with the bound material is rotated so as to position the bound material at each of top, bottom and front edge cutting positions by the rotate mechanism. Then, the trim knife reciprocates at each of the positions to cut the top, bottom and front edge portions.

The other conventional trimmer is described in, for example, Patent Document 3. The trimmer comprises: a trim knife; a blade receiving portion for receiving the blade edge of the trim knife; and an adjustment mechanism for adjusting the position of the blade receiving portion. The adjustment mechanism causes the blade receiving portion to be toward and away from the blade edge of the trim knife so as to adjust the position of the blade receiving portion. Thus, in case that the bound material cannot be trimmed completely, the adjustment mechanism can adjust the position of the blade receiving portion so as to trim the bound material completely.

The adjustment mechanism of Patent Document 3 moves the blade receiving portion while keeping in a direction parallel to a horizontal direction. However, the bound material is rarely trimmed incompletely along the entire region of the trim knife, while the bound material is often trimmed incompletely along only the region of one side of the trim knife. The blade receiving portion moves toward the trim knife in the region not only where the bound material cannot be trimmed completely but also where the bound material can be trimmed completely because the adjustment mechanism of Patent Document 3 moves the blade receiving portion while keeping a direction parallel to a horizontal direction as described above. Thus, in the case of the adjustment mechanism of Patent Document 3, there is a problem that the lifetime of the blade receiving portion becomes shorter because the trim knife unnecessarily digs into the blade receiving portion even in the region where the bound material can be trimmed completely.

Patent Document 1: JP 2004-066347 A

Patent Document 2: U.S. Pat. No. 7,493,840 B

Patent Document 3: JP 2008-30131 A

SUMMARY OF THE INVENTION

Problems to be Solved by the Invention

It is an object of the present invention to provide a trimmer which can properly adjust a position of a blade receiving portion.

Solution to the Problems

In order to achieve the object, the present invention provides a trimmer for trimming a hound material, comprising:

a trim knife that trims the bound material;

a blade receiving portion that receives a blade edge of the trim knife; and an adjustment mechanism configured to adjust a position of the blade receiving portion in such a manner that each of one side and other side of the blade receiving portion is moved by not only a same amount but also a different amount and in directions toward and away from the blade edge of the trim knife.

According to a preferred embodiment of the present invention, wherein the adjustment mechanism comprises:

first and second motors;

a first connecting portion configured to connect the one side of the blade receiving portion with the first motor; and a second connecting portion configured to connect the other side of the blade receiving portion with the second motor, whereby each of the one side and the other side of the blade receiving portion is moved in the directions toward and away from the blade edge of the trim knife.

According to a preferred embodiment of the present invention, wherein the trimmer further comprises:

a base portion configured to receive the blade receiving portion, wherein the first connecting portion comprises a first eccentric cam provided on the one side of the base portion, and wherein the second connecting portion comprises a second eccentric earn provided on the other side of the base portion.

According to a preferred embodiment of the present invention, wherein the first connecting portion comprises a first belt connected between an output axis of the first motor and a shaft of the first eccentric cam; and wherein the second connecting portion comprises a second belt connected between an output axis of the second motor and a shaft of the second eccentric cam.

Effect of the Invention

The trimmer according to the present invention can properly adjust a position of a blade receiving portion. Thus, the lifetime of the blade receiving portion becomes longer because the trim knife does not unnecessarily dig into the blade receiving portion in the region where the hound material can be trimmed completely. Even if the trim knife is sidlingly attached, there is no need to detach and attach the trim knife again properly because the position of the blade receiving portion can be adjusted properly.

DETAILED EXPLANATION OF THE PREFERRED EMBODIMENTS

A trimmer according to the present invention will be explained hereinbelow with reference to the figures.

Trimmer

Figure 1:
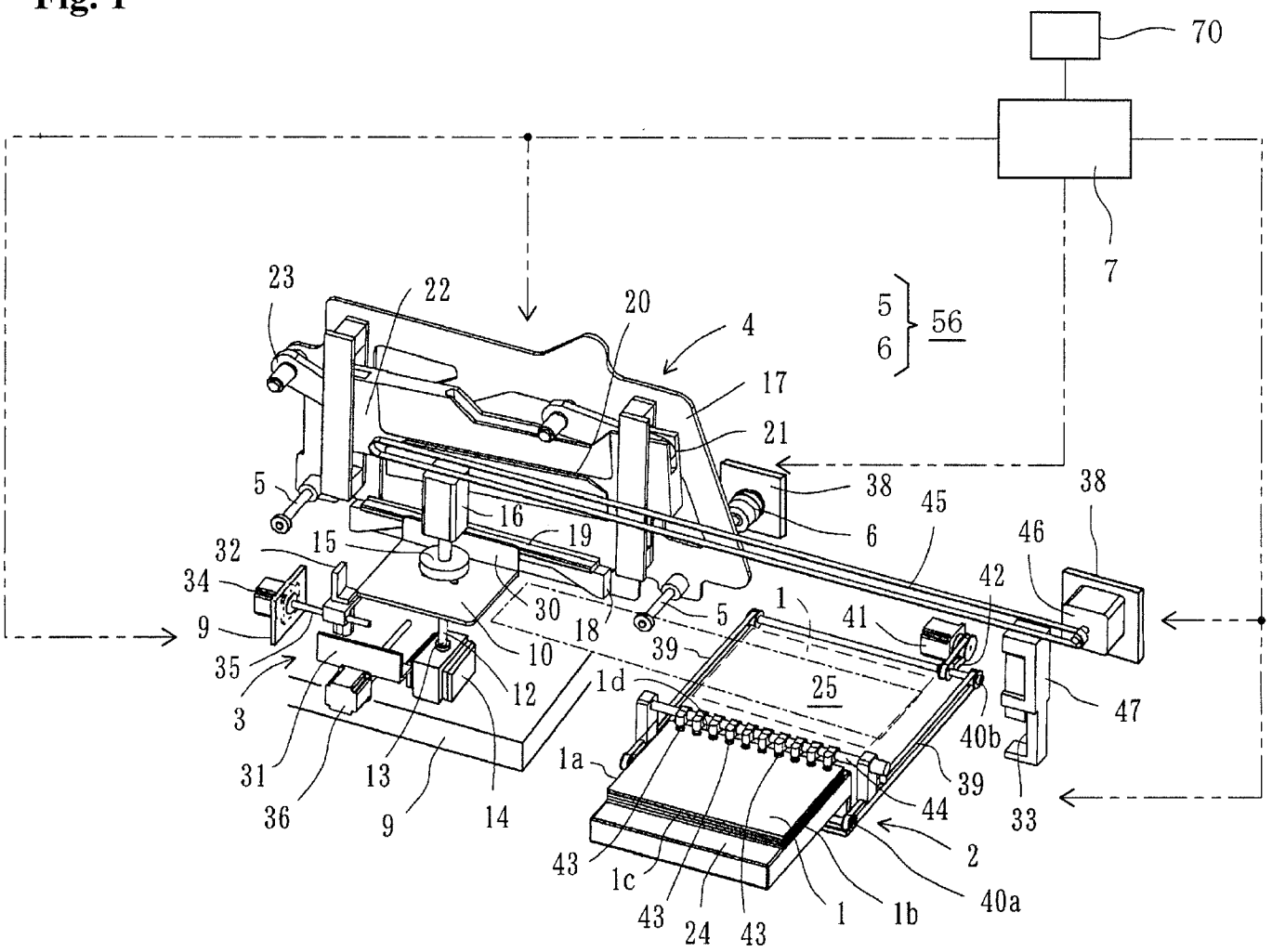
FIG. 1 is a schematic perspective view showing a trimmer according to the present invention before a bound material is fed from a hound material feeding unit of a bound material loading table.
Figure 2:
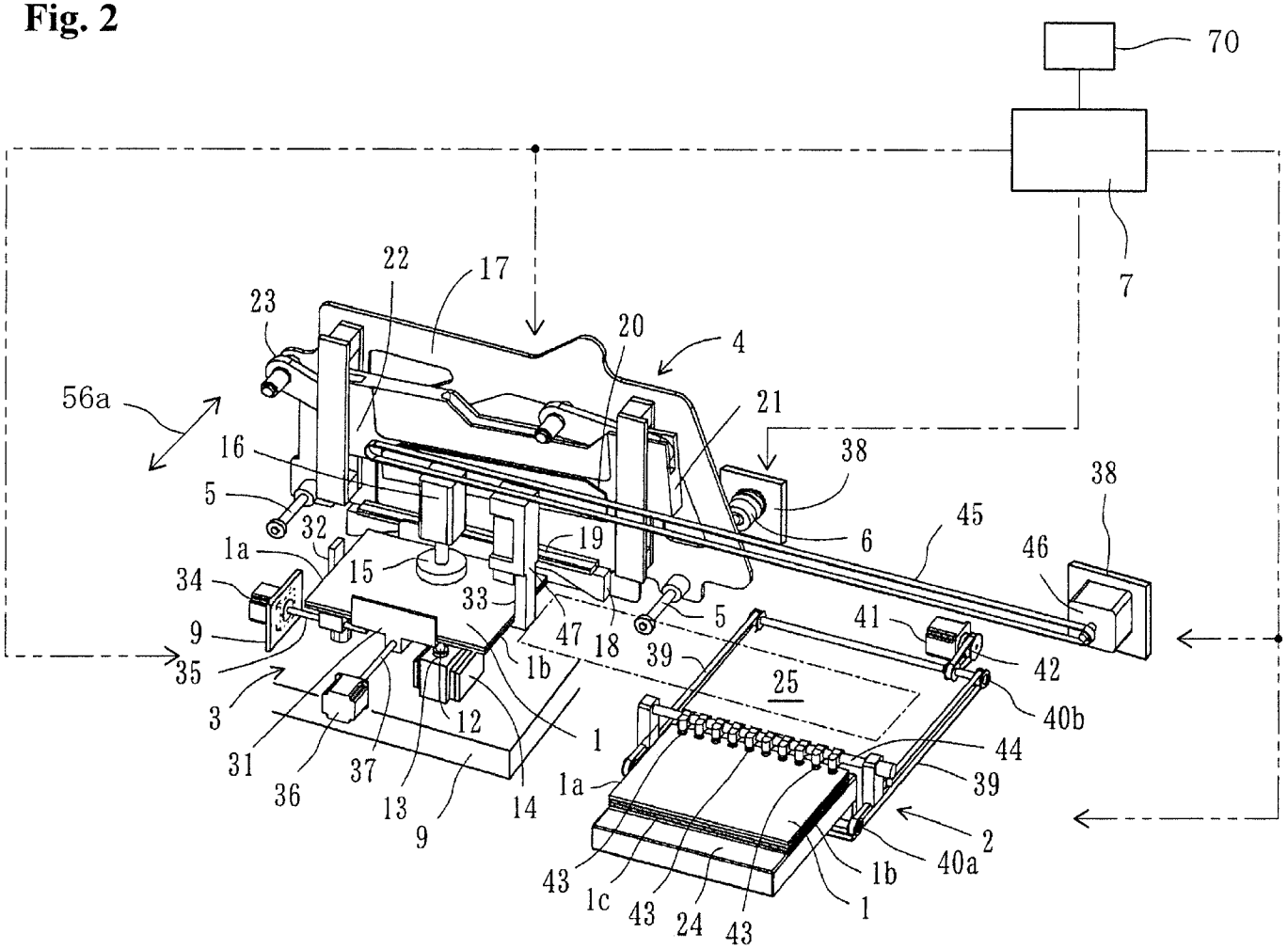
FIG. 2 is a schematic perspective view showing the trimmer of FIG. 1 in which the bound material is positioned on a table of a table unit.

Referring to FIGS. 1 and 2, a structure of the trimmer will be explained. The trimmer comprises: a bound material feeding unit 2 for feeding a bound material 1 one by one; a table unit 3 receiving the bound material 1 from the bound material feeding unit 2 thereon at a predetermined position and rotatable with the bound material 1 at every predetermined angle in such a manner that the bound material 1 is positioned at each of top, front and bottom edge cutting positions; and a trim unit 4 arranged for movement in directions toward and away from the table unit 3. The trim unit 4 is configured to be moved between a cutting position and a stand-by position. The cutting position is adjacent to the table unit 3 for trimming a top edge area 1*a*, a bottom edge area 1*b* and a front edge area 1*c* of the bound material 1, respectively. The stand-by position is away from the table unit 3.

The bound material feeding unit 2 has a bound material loading table 24 on which a stack of the bound materials 1 is placed. A path 25 for transporting the bound material 1 extends between the table unit 3 and the bound material loading table 24. A discharge end of the path 25 is adjacent to the table unit 3, while a side section of a supply end thereof is adjacent to the bound material loading table 24.

The bound material feeding unit 2 also has a bound material feeding mechanism that feeds the bound material 1 from the bound material loading table 24 toward the path 25, one by one. The bound material feeding mechanism has a pair of endless belts 39 extending across and perpendicularly to the path 25 from both sides of the bound material loading table 24, and rollers 40*a* and 40*b* between which the endless belts 39 are extended. A support bar 44 having substantially a reverse U-shape is fixed to the pair of the endless belts 39. A plurality of suction heads 43 is mounted on the support bar 44 and faces downward. Suction heads 43 are spaced in a length direction of the support bar 44. In this way, the line of the suction heads 43 reciprocates between the bound material loading table 24 and the path 25 in a direction perpendicular to the path 25 by a drive of a motor 41.

The bound material feeding unit 2 also has a bound material transporting mechanism which transports the bound material 1 received from the bound material feeding mechanism on the path 25 toward the table unit 3 along the path 25. The bound material transporting mechanism has an endless belt 45 extending along and above the path 25 and rotatably supported by a frame 38. The endless belt 45 is rotatably driven by a motor 46 mounted to the frame 38. A chuck 47 is hung with the endless belt 45 and reciprocates between the bound material loading table 24 and the table 10 on the path 25 by the drive of the motor 46.

As described above, the bound material 1 placed on the bound material loading table 24 is absorbed one by one by the line of the suction heads 43, and then, it is fed in the direction perpendicular to the transporting direction of the bound material 1 to the path 25 in which its back 1*d* faces forward. The bound material 1 is gripped by the chuck 47 at this position. At this time, the face 33 of the chuck 47 comes in contact with the bottom edge 1*b* of the bound material 1. Then, the absorption by the line of the suction heads 43 is released, whereby the bound material 1 is transferred to the chuck 47. Thereafter, the chuck 47 moves toward the table unit 3 on the path 25, and when the top edge 1*a* of the bound material 1 comes in contact with the second upright plate 32, it stops. Thus, the bound material 1 is positioned on the table 10 in the top-to-bottom direction.

The table unit 3 has a base 9 and a rectangular table 10 which is provided with the top surface for supporting a bottom surface of a section of the bound material 1 except for the top edge portion 1*a*, the bottom edge portion 1*b* and the front edge portion 1*c* thereon. The table unit 3 also has positioning means for positioning the bound material 1 on the top surface of the table 10.

In this embodiment, the positioning means has a first upright plate 30 arranged on one side edge of the table 10, wherein a back 1*d* of the bound material 1 comes in contact with the upright plate 30. The first upright plate 30 is coupled to a slide driving mechanism (not shown) attached to the bottom surface of the table 10. Further, the positioning means has a second upright plate 32 to which the top edge 1*a* of the bound material 1 can contact. The second upright plate 32 is mounted on a feed screw 35 that is rotatably driven by a motor 34 supported by the base 9. In this way, the first and second upright plates 30 and 32 move in directions toward and away from the table 10 and they stop at a predetermined position corresponding to both a size and a receive position of the bound material 1 fed from the bound material feeding unit 2 (see FIG. 1).

The positioning means is further provided with a third upright plate 31 arranged opposite to the first upright plate 30 with the table 10 therebetween, so that the front edge 1*c* of the bound material 1 comes in contact with the third upright plate 31. The third upright plate 31 is mounted on a feed screw 37 which is rotatably driven by a motor 36 supported by the base 9, like the second upright plate 32, so that it moves in directions toward and away from the table 10. When the bound material 1 is placed on the table 10, the third upright plate 31 moves in a direction toward the bound material 1 until the back 1*d* of the bound material 1 comes in contact with the first upright plate 30 and the third upright plate 31 comes in contact with the front edge 1*c*. This achieves the positioning of the bound material 1 placed on the table 10 in the back-to-front direction (see FIG. 2).

The face 33 of the chuck 47 of the bound material feeding unit 2 that comes in contact with the bottom edge 1*b* of the bound material 1 also functions as a part of the positioning means. It performs the positioning of the bound material 1 in the top-to-bottom direction along with the second upright plate 32 (see FIG. 2).

A vertical shaft 12 is mounted on the bottom surface of the table 10, and the shaft 12 is held so as to be rotatable by a bearing 13 attached to the base 9. A motor 14 is coupled to the shaft 12, whereby the table 10 is rotatably driven by the motor 14.

A pressure plate 15 is arranged opposite to the shaft 12 above the table 10 for upwardly and downwardly movement between two positions of a stand-by position at which it is spaced from the bound material 1, and a pressure position at which it presses the bound material 1 against the table 10. The pressure plate 15 is attached to a piston-cylinder device 16 supported by the base 9 such that it can rotate at the pressure position along with the table 10 and the bound material 1. It is reciprocated between the stand-by position and the pressure position by the drive of the piston-cylinder device 16.

After the bound material 1 is positioned by the positioning means 30, 31, 32 and 33, the pressure plate 15 moves to the pressure position so as to fix the bound material 1 to the table 10. After the pressure plate 15 is disposed on the pressure position, the third upright plate 31 and the chuck 47 (the face 33) of the positioning means are separated from the bound material 1 in order not to obstruct the rotational movement of the bound material 1.

The trim unit 4 has a frame 17. A base portion 18 is attached to the frame 17. When the trim unit 4 is disposed on the cutting position, the base portion 18 supports the bottom surface of the top edge portion 1*a*, the bottom edge portion 1*b* or the front edge portion 1*c* of the bound material 1 placed on the table 10 of the table unit 3.

A trim knife 20 is arranged opposite to the blade receiving portion 19 above the base portion 18 for upwardly and downwardly movement. The trim knife 20 takes two positions of a non-cutting position, at which it is spaced from the blade receiving plate 19, and a cutting position, at which it is pushed against the blade receiving portion 19 at its edge. A trim knife driving mechanism 21 is attached to the frame 17 for reciprocating the trim knife 20 between the cutting position and the non-cutting position.

The trim unit 4 comprises the blade receiving portion 19 for receiving the trim knife 20. The blade receiving portion 19 is fixed to the upper surface of the base portion 18. The blade receiving portion 19 is, for example, made of a rubber material.

A pressure member 22 is arranged above the base portion 18 for movement upwardly and downwardly between two positions of a non-pressing position where it is spaced from the bound material 1, and a pressing position where the bound material 1 is pressed against the base portion 18. The pressure member 22 is reciprocated between the non-pressing position and the pressing position by a pressure member driving mechanism 23. The pressure member 22 is disposed on the pressing position when the trim knife 20 moves from the non-cutting position to the cutting position, while the pressure member 22 is disposed on the non-pressing position when the trim knife 20 moves from the cutting position to the non-cutting position.

Two feed screws 5 are arranged horizontally between the table unit 3 and the trim unit 4, and they 5 are spaced from each other. The feed screws 5 are rotatably mounted to a support member (not shown) fixed to another frame (main frame) 38. The frame 17 of the trim unit 4 is engaged with the feed screws 5. The feed screws 5 are coupled to a driving shaft of a motor 6 mounted on the frame 38, whereby the feed screws 5 are rotatably driven by the motor 6. A driving mechanism 56 is composed of the feed screws 5 and the motor 6. The driving mechanism 56 causes the trim unit 4 to move between the cutting position and the stand-by position along the axis direction of the feed screws 5.

There is provided a control unit 7 for controlling the operations of the table unit 3, the trim unit 4 and the driving mechanism 56 (the motor 6). The control unit 7 controls them in such a manner that the trim unit 4 moves from the stand-by position to the cutting position every time the bound material 1 is arranged at each of the top edge cutting position, the front edge cutting position and the bottom edge cutting position, to cut each of the top edge portion 1*a*, the front edge portion 1*c* and the bottom edge portion 1*b* of the bound material 1, respectively. A touch screen 70 is further connected to the control unit 7, by which an operator can set up the table unit 3, the trim unit 4 and the driving mechanism 56 (the motor 6).

Trimming Process

Figure 3A:
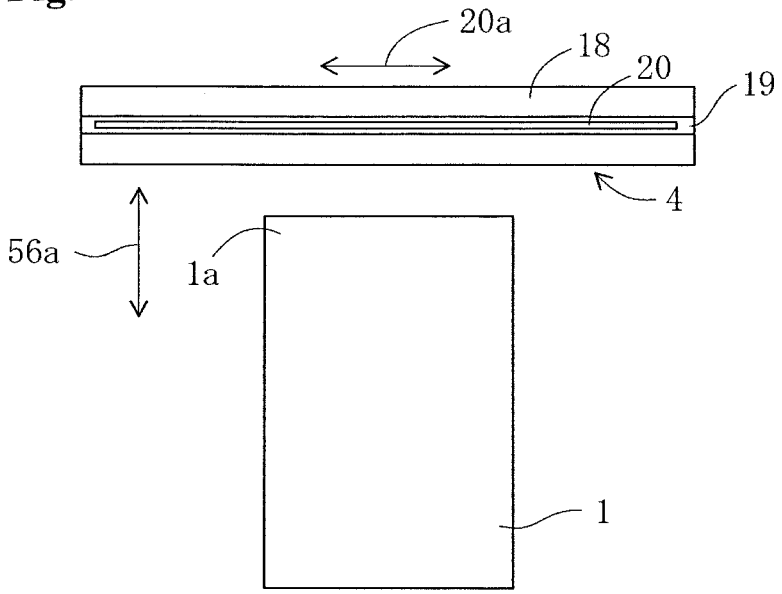
FIG. 3A is a plan view illustrating a trimming process of the trimmer according to the present invention in which a trim knife is disposed at a stand-by position.
Figure 3B:
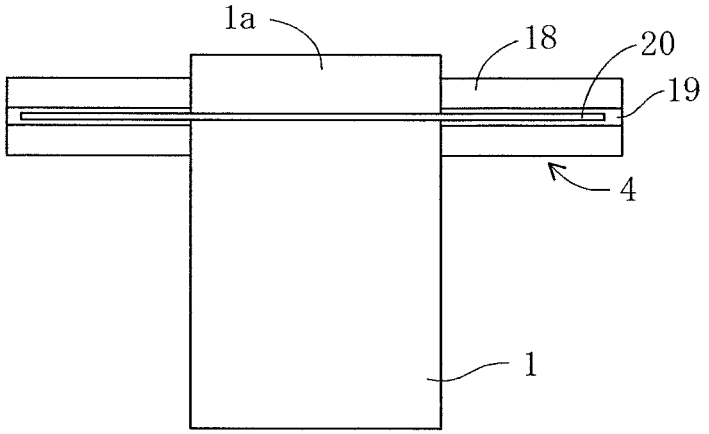
FIG. 3B is a plan view illustrating the trimming process of the trimmer according to the present invention in which the trim knife is disposed at a cutting position.
Figure 4A:
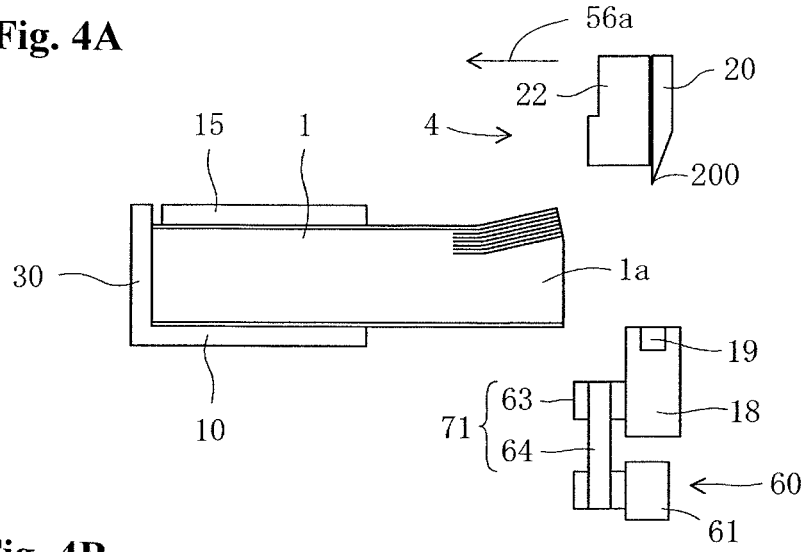
FIG. 4A is a side view illustrating the trimming process of the trimmer corresponding to FIG. 3A.

Referring to FIGS. 3 and 4, a process for trimming the top edge portion 1*a* of the bound material 1 will be explained. At first, as shown in FIGS. 3A and 4A, the table unit 3 rotates the table 10 in such a manner that an edge of the top edge portion 1*a* of the bound material 1 is arranged in parallel to the trim knife 20 and the bound material 1 is arranged at the top edge cutting position. At this time, the trim unit 4 (the trim knife 20) is arranged at the stand-by position away from the top edge portion 1*a* of the bound material 1. As shown in FIG. 4A, the trim knife 20 is arranged at the non-cutting position above the bound material 1, and the pressure member 22 is arranged at the non-pressing position above the bound material 1.

Figure 4B:
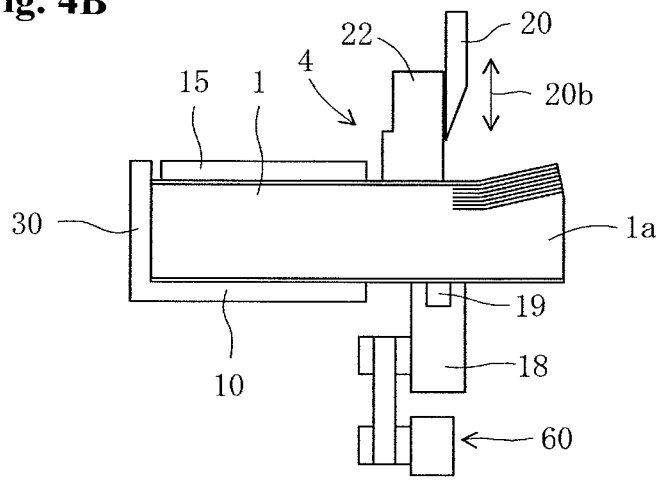
FIG. 4B is a side view illustrating the trimming process of the trimmer corresponding to FIG. 3B.
Figure 4C:
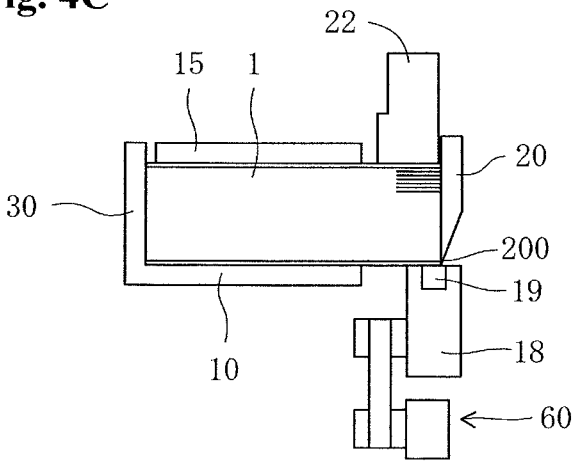
FIG. 4C is a side view illustrating the trimming process of the trimmer in which the trim knife is disposed at a cutting position from a non-cutting position.

Then, as shown in FIG. 3B, the trim unit 4 moves in the moving direction 56*a* perpendicular to a length direction 20*a* of the trim knife 20. The trim unit 4 is arranged at the cutting position from the stand-by position. At this time, the trim knife 20 is arranged at the non-cutting position, and the pressure member 22 is arranged at the non-pressing position. Then, as shown in FIG. 4B, the pressure member 22 moves downwardly to the pressing position by the pressure member driving mechanism 23 so as to press the bound material 1 against the base portion 18. Then, as shown in FIG. 4C, the trim knife 20 moves toward the blade receiving portion 19 in a movement direction 20*b* by the trim knife driving mechanism 21. And then, the trim knife 20 moves downwardly to the cutting position so as to press the blade edge 200 thereof against the blade receiving portion 19, whereby the top edge portion 1*a* of the bound material 1 is trimmed.

Then, the trim knife 20 moves away from the blade receiving portion 19 in the movement direction 20 by the trim knife driving mechanism 21. And then, the trim knife 20 moves upwardly to the non-cutting position away from the bound material 1. The pressure member 22 further moves upwardly to the non-pressing position away from the bound material 1. The bottom edge portion 1*b* of the bound material 1 is trimmed through the same process as above described.

Adjustment Mechanism of Blade Receiving Portion

Referring to FIG. 5, an adjustment mechanism of the blade receiving portion will be explained. As shown in FIGS. 5 and 4, the trimmer comprises the adjustment mechanism 60 for adjusting a position of the blade receiving portion 19. The blade receiving portion 19 extends in a length direction 19*a*. The adjustment mechanism 60 comprises first and second motors 61 and 62, a first connecting portion 71 for connecting one side 191 of the blade receiving portion 19 and the first motor 61, and a second connecting portion 72 for connecting the other side 191 of the blade receiving portion 19 and the second motor 62. The one side 191 and the other side 192 of the blade receiving portion 19 are disposed at opposite sides of the length direction 19*a*. The blade receiving portion 19 is supported on the base portion 18 so as to be freely mounted and dismounted. The base portion 18 extends in the length direction 19*a* of the blade receiving portion 19.

The first connecting portion 71 comprises a first eccentric cam 63 provided on the one side 191 of the blade receiving portion 19. The first eccentric cam 63 is attached to an elongate hole 183 provided in a one side 181 of the base portion 18 so as to be able to rotate and move relative to the base portion 18 through the elongate hole 183. The elongate hole 183 extends in the length direction 19*a*. The first connecting portion 71 comprises a first belt 64 connected between a shaft 630 of the first eccentric cam 63 and an output axis 610 of the first motor 61. Both the first motor 61 and the shaft 630 of the first eccentric cam 63 are fixed to a frame (not shown) of the trimmer. Thus, each of distances between the first motor 61, the shaft 630 of the first eccentric cam 63 and the blade edge 200 of the trim knife 20 maintains constant because of being fixed to the frame of the trimmer. On the other hand, the first eccentric cam 63 is rotated by the rotation of the output axis 610 of the first motor 61, whereby the one side 181 of the base portion 18 (the one side 191 of the blade receiving portion 19) is moved in movement directions 19*b* toward and away from the blade edge 200 of the trim knife 20. Thus, the distance between the one side 191 of the blade receiving portion 19 (the one side 181 of the base portion 18) and the blade edge 200 of the trim knife 20 may be changed.

The second connecting portion 72 comprises a second eccentric cam 65 provided on the other side 192 of the blade receiving portion 19. The second eccentric cam 65 is attached to a hole 184 provided in the other side 182 of the base portion 18 so as to be able to rotate relative to the base portion 18 through the hole 184. The hole 184 is the same size as the second eccentric cam 65. The second connecting portion 72 comprises a second belt 66 connected between a shaft 650 of the second eccentric cam 65 and an output axis 620 of the second motor 62. Both the second motor 62 and the shaft 650 of the second eccentric cam 65 are fixed to the frame (not shown) of the trimmer. Thus, each of distances between the second motor 62, the shaft 650 of the second eccentric cam 65 and the blade edge 200 of the trim knife 20 maintains constant because of being fixed to the frame of the trimmer. On the other hand, the second eccentric cam 65 is rotated by the rotation of the output axis 620 of the second motor 62, whereby the other side 182 of the base portion 18 (the other side 192 of the blade receiving portion 19) is moved in the movement directions 19*b* toward and away from the blade edge 200 of the trim knife 20. Thus, the distance between the other side 192 of the blade receiving portion 19 (the other side 182 of the base portion 18) and the blade edge 200 of the trim knife 20 may be changed.

A reference line 100 connected between centers of the shaft 630 of the first eccentric earn 630 and the shaft 650 of the second eccentric cam 65 is parallel to the length direction 20*a* (the horizontal direction) of the trim knife 20. The reference line 100 does not move because both the shaft 630 of the first eccentric cam 63 and the shaft 650 of the second eccentric cam 65 are rotatably mounted on the frame of the trimmer, as above described.

The first and second motors 61 and 62 are connected with the control unit 7. The control unit 7 is configured to control the amount of rotation of the output axes 610 and 620 of the first and second motors 61 and 62. Thus, the adjustment mechanism 60 adjusts the position of the blade receiving portion 19.

In case that each of the output axes 610 and 620 of the first and second motors 61 and 62 rotates by the same amount, each of the one and other sides 181 and 182 of the base portion 18 (the one and other sides 191 and 192 of the blade receiving portion 19) also moves by the same amount and in the movement direction 19*b*. On the other hand, in case that each of the output axes 610 and 620 of the first and second motors 61 and 62 rotates by a different amount, each of the one and other sides 181 and 182 of the base portion 18 (the one and other sides 191 and 192 of the blade receiving portion 19) also moves by the different amount and in the movement direction 19*b*.

Figures 5A, 5B, 5C, 5D:
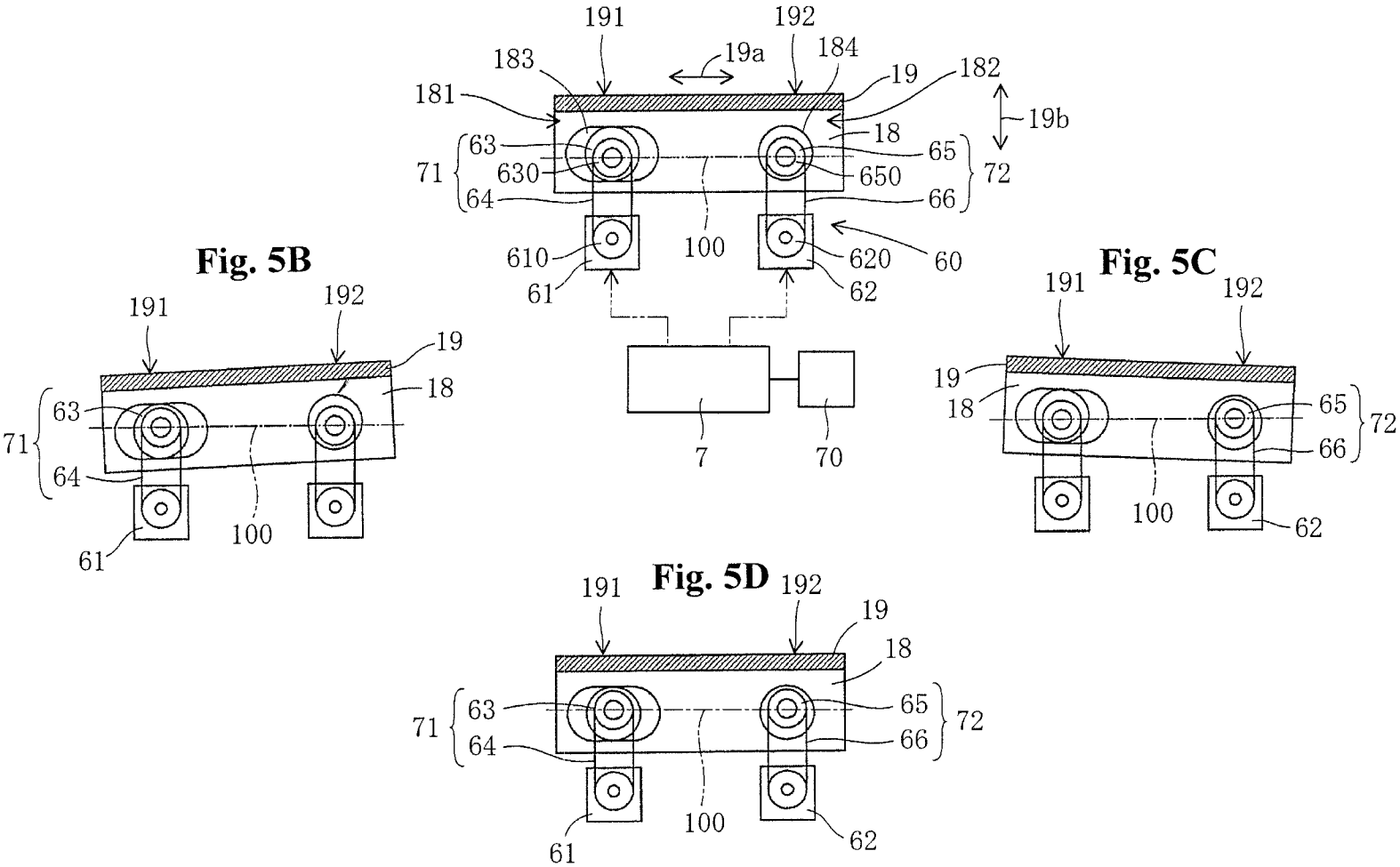
FIGS. 5A and 5D are front views showing a blade receiving portion disposed in a direction parallel to a horizontal direction.
FIGS. 5B and 5C are front views showing the blade receiving portion disposed in a direction inclined to the horizontal direction.

In FIG. 5A, the blade receiving portion 19 is disposed in a direction parallel to the horizontal direction (the reference line 100) and adjacent to the blade edge 200 of the trim knife 20. In FIG. 5B, the blade receiving portion 19 is disposed in a direction inclined to the horizontal direction (the reference line 100), and the one side 191 of the blade receiving portion 19 is away from the blade edge 200 of the trim knife 20 while the other side 192 of the blade receiving portion 19 is adjacent to the blade edge 200 of the trim knife 20. In FIG. 5C, the blade receiving portion 19 is disposed in a direction inclined to the horizontal direction (the reference line 100), and the one side 191 of the blade receiving portion 19 is adjacent to the blade edge 200 of the trim knife 20 while the other side 192 of the blade receiving portion 19 is away from the blade edge 200 of the trim knife 20. In FIG. 5D, the blade receiving portion 19 is disposed in a direction parallel to the horizontal direction (the reference line 100) and away from the blade edge 200 of the trim knife 20.

Figure 6:
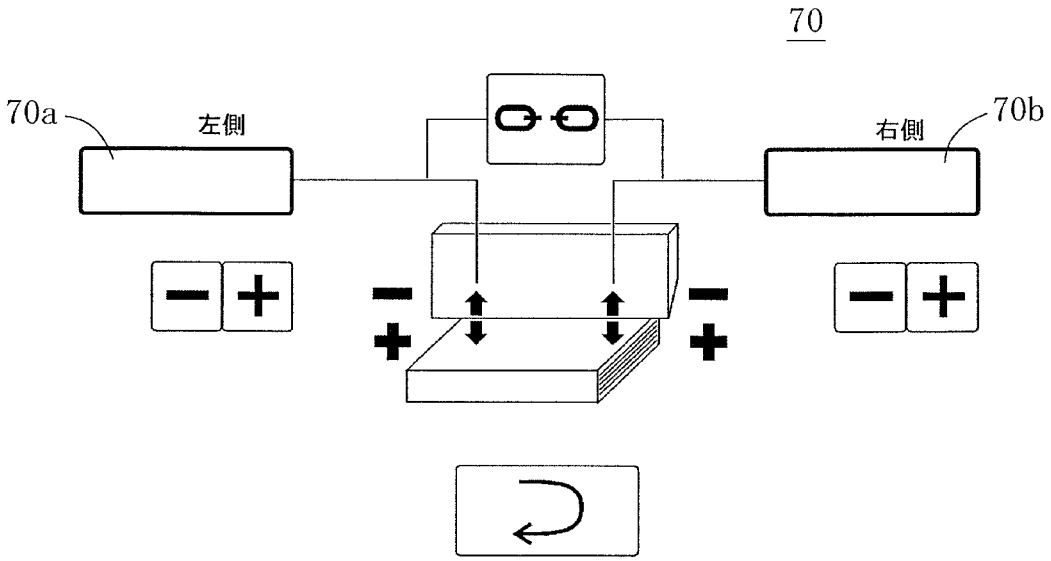
FIG. 6 is a front view showing a setting screen displayed on a touch screen.

As shown in FIG. 6, a setting screen displayed on the touch screen 70 is provided with a "+" button, a "−" button, and first and second display portions 70*a* and 70*b* each of which corresponds to each of the one and other sides 191 and 192 of the blade receiving portion 19. An operator inputs values corresponding to the amounts of rotation of the first and second motors 61 and 62 through the "+" and "−" buttons. In short, the operator presses the "+" and "−" buttons so as to increase and decrease the values displayed on the first and second display portions 70*a* and 70*b*. The control unit 7 is configured to control the amount of rotation of the first and second motors 61 and 62 depending on the values displayed on the first and second display portions 70*a* and 70*b*, whereby the positions of the one and other sides 191 and 192 of the blade receiving portion 19 can be adjusted.

As a result, the trimmer according to the present invention can properly adjust the positions of the one and other sides 191 and 192 of the blade receiving portion 19. Thus, the lifetime of the blade receiving portion 19 becomes longer because the trim knife 20 does not unnecessarily dig into the blade receiving portion 19 in the region where the bound material 1 can be trimmed completely. Even if the trim knife 20 is attached sidlingly, there is no need to detach and attach the trim knife 20 again because the position of the blade receiving portion 19 can be adjusted properly.

In the case of another embodiment, not the first and second belts 64 and 66 but link materials may connect the first and second eccentric cams 63 and 65 with the first and second motors 61 and 62. In the case of another embodiment in which the bound material 1 stands when being cut, the reference line 100 parallel to the length direction 20*a* of the trim knife 20 is disposed in a vertical direction because the length direction 20*a* of the trim knife 20 is disposed in the vertical direction. In the case of another embodiment in which the trimmer is not the three-side trimmer, the operator may rotate and position the bound material 1 at each of top, bottom and front edge cutting positions by one's self.

DESCRIPTION OF THE REFERENCE CHARACTERS

1 bound material
18 base portion
181 one side of the base portion
182 the other side of the base portion
183 elongate hole
184 hole
19 blade receiving portion
191 one side of the blade receiving portion
192 the other side of the blade receiving portion
19*a* length direction of the blade receiving portion
19*b* movement direction of the blade receiving portion
60 adjustment mechanism
61 first motor
62 second motor
63 first eccentric cam
64 first belt
65 second eccentric cam
66 second belt
71 first connecting portion
72 second connecting portion
200 trim knife
20*a* length direction of the trim knife
100 reference line
7 control unit
70 touch screen

What is claimed is:

1. A trimmer for trimming a bound material, comprising:
a trim knife that trims the bound material;
a blade receiving portion having an upper surface that receives a blade edge of the trim knife, the blade edge of the trim knife being pushed against the blade receiving portion in a cutting plane of the trim knife, wherein the cutting plane is disposed orthogonal to the upper surface of the blade receiving portion when the trim knife is arranged at a cutting position and being spaced from the blade receiving portion when the trim knife is arranged at a non-cutting position;
a base portion which supports a bottom of the bound material, wherein the blade receiving portion is fixed to an upper surface of the base portion;
a trim knife reciprocator that reciprocates the trim knife between the cutting position and the non-cutting position;
a first adjuster which adjusts a first distance between one side of the blade receiving portion and the blade edge of the trim knife; and
a second adjuster which adjusts a second distance between the other side of the blade receiving portion and the blade edge of the trim knife,
wherein the first adjuster and the second adjuster are configured to adjust the first distance and the second distance such that each of one side and the other side of the blade receiving portion is configured to move by a same amount in directions toward and away from a blade edge of the trim knife and to move by a different amount in directions toward and away from the blade edge of the trim knife.

2. The trimmer according to claim 1, wherein the first adjuster comprises a first motor and the second adjuster comprises a second motor;
a first connecting portion configured to connect the one side of the blade receiving portion with the first motor; and
a second connecting portion configured to connect the other side of the blade receiving portion with the second motor, whereby each of the one side and the other side of the blade receiving portion is moved in the directions toward and away from the blade edge of the trim knife.

3. The trimmer according to claim 2,
wherein the first connecting portion comprises a first eccentric cam provided on the one side of the base portion, and
wherein the second connecting portion comprises a second eccentric cam provided on the other side of the base portion.

4. The trimmer according to claim 3, wherein
the first connecting portion comprises a first belt connected between an output axis of the first motor and a shaft of the first eccentric cam; and wherein
the second connecting portion comprises a second belt connected between an output axis of the second motor and a shaft of the second eccentric cam.

5. The trimmer according to claim 1, further comprising:
an inputting portion configured to input a first value for adjusting the first distance and a second value for adjusting the second distance,
wherein the first adjuster is configured to adjust the first distance on the basis of the first value inputted by the inputting portion, and
wherein the second adjuster is configured to adjust the second distance on the basis of the second value inputted by the inputting portion.

6. A trimmer for trimming a bound material, comprising:
a trim knife that trims the bound material;
a blade receiving portion having an upper surface that receives a blade edge of the trim knife, the blade edge of the trim knife being pushed against the blade receiving portion in a traveling direction of the trim knife in a cutting plane of the trim knife, wherein the cutting plane is disposed orthogonal to the upper surface of the blade receiving portion when the trim knife is arranged at a cutting position and being spaced from the blade receiving portion when the trim knife is arranged at a non-cutting position;
first and second motors;
a first connecting portion configured to connect a first side of the blade receiving portion and the first motor for movement of the first side a first distance;
a second connecting portion configured to connect a second side of the blade receiving portion and the second motor for movement of the second side a second distance; and
a control portion configured to control the first motor and the second motor such that each of the first side and the second side of the blade receiving portion is configured to move by a same amount in directions toward and away from a blade edge of the trim knife and to move by a different amount in directions toward and away from the blade edge of the trim knife, the first distance being a distance between the first side of the blade receiving portion and the blade edge of the trim knife, the second distance being a distance between the second side of the blade receiving portion and the blade edge of the trim knife.

* * * * *